US008770502B1

(12) United States Patent
Hutchinson

(10) Patent No.: US 8,770,502 B1
(45) Date of Patent: Jul. 8, 2014

(54) DEMOLITION MACHINE RETROFIT METHOD AND APPARATUS AND DEMOLITION METHOD

(75) Inventor: Brad Hutchinson, Rushville, OH (US)

(73) Assignee: Company Wrench, Ltd., Carroll, OH (US)

( * ) Notice: Subject to any disclaimer, the term of this patent is extended or adjusted under 35 U.S.C. 154(b) by 448 days.

(21) Appl. No.: 13/158,888

(22) Filed: Jun. 13, 2011

Related U.S. Application Data

(60) Provisional application No. 61/397,599, filed on Jun. 14, 2010.

(51) Int. Cl.
*B02C 1/00* (2006.01)

(52) U.S. Cl.
USPC ..... 241/30; 241/101.01; 241/101.73

(58) Field of Classification Search
USPC ..... 241/101.71–101.78, 30, 101.01
See application file for complete search history.

(56) References Cited

U.S. PATENT DOCUMENTS

| | | | | |
|---|---|---|---|---|
| 4,425,072 | A | 1/1984 | Lewis | |
| 4,670,983 | A | 6/1987 | Ramun et al. | |
| 5,044,569 | A | 9/1991 | LaBounty et al. | |
| 5,060,378 | A | 10/1991 | LaBounty et al. | |
| RE35,432 | E | 1/1997 | LaBounty et al. | |
| 5,628,611 | A | 5/1997 | Ito et al. | |
| 5,704,560 | A | 1/1998 | Wimmer | |
| 5,894,666 | A | 4/1999 | Hrusch | |
| 5,926,958 | A | 7/1999 | Ramun | |
| 5,940,971 | A | 8/1999 | Ramun | |
| 6,015,108 | A | 1/2000 | Okumura et al. | |
| 6,061,911 | A | 5/2000 | LaBounty et al. | |
| 6,119,970 | A | 9/2000 | LaBounty et al. | |
| 6,129,298 | A | 10/2000 | Nye | |
| 6,202,308 | B1 | 3/2001 | Ramun | |
| 6,439,317 | B1 | 8/2002 | Minotti et al. | |
| 6,481,949 | B1 | 11/2002 | Cullen | |
| 6,839,969 | B2 | 1/2005 | Jacobson et al. | |
| 6,915,972 | B2 * | 7/2005 | Rossi, Jr. | 241/101.72 |
| 6,926,217 | B1 | 8/2005 | LaBounty et al. | |
| 6,994,284 | B1 | 2/2006 | Ramun | |
| 7,108,211 | B2 | 9/2006 | Ramun | |
| 7,121,489 | B2 | 10/2006 | Ramun | |
| 7,216,575 | B2 | 5/2007 | Alseth et al. | |
| 7,255,295 | B2 | 8/2007 | Ramun | |
| 7,284,330 | B2 | 10/2007 | Wagner | |
| 7,284,718 | B2 | 10/2007 | Christenson | |
| 7,284,720 | B2 | 10/2007 | Ramun | |
| 7,306,177 | B2 | 12/2007 | Ward | |
| 7,311,126 | B2 | 12/2007 | Sharp | |
| 7,354,010 | B2 | 4/2008 | Ramun et al. | |
| 7,407,017 | B2 | 8/2008 | Robson | |
| 2007/0001041 | A1 | 1/2007 | Christenson | |

FOREIGN PATENT DOCUMENTS

| | | |
|---|---|---|
| WO | WO 01/68992 | 9/2001 |

* cited by examiner

*Primary Examiner* — Mark Rosenbaum
(74) *Attorney, Agent, or Firm* — Roger A. Gilcrest

(57) ABSTRACT

The invention may be described as a shear tool or concrete pulverizer retrofit method, a hybrid demolition machine, such as one resulting from such a method, and a demolition method that may be carried out using such a demolition machine.

4 Claims, 1 Drawing Sheet

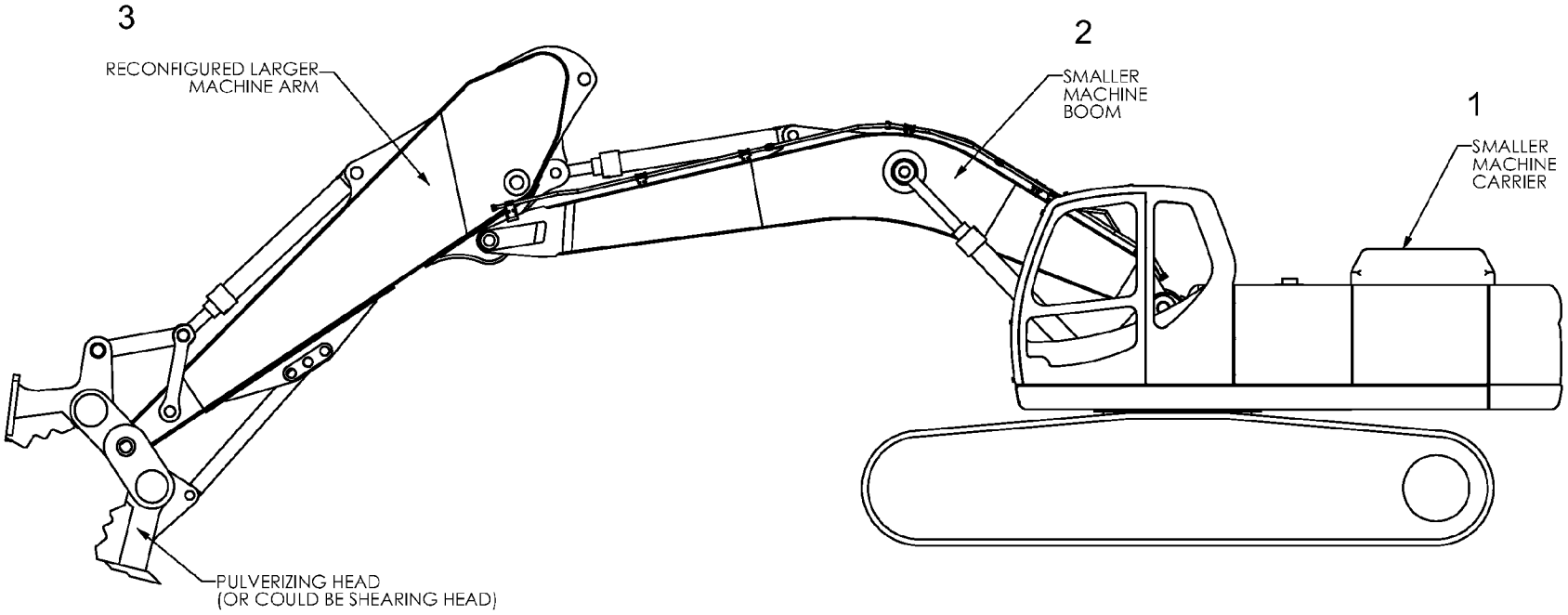
1
SMALLER MACHINE CARRIER
2
SMALLER MACHINE BOOM
3
RECONFIGURED LARGER MACHINE ARM
PULVERIZING HEAD (OR COULD BE SHEARING HEAD)

DEMOLITION MACHINE RETROFIT METHOD AND APPARATUS AND DEMOLITION METHOD

RELATED APPLICATION DATA

This application claims the priority benefit of U.S. Provisional Application Ser. No. 61/397,599, filed Jun. 14, 2010, which is hereby incorporated in its entirety herein by reference.

FIELD OF THE INVENTION

The present invention relates to a hybrid demolition shear and a hybrid concrete pulverizing apparatus and methods of their manufacture and use.

BACKGROUND

In the field of construction demolition, one of the principal measures of performance is the amount of scrap material that can be moved from a demolition site within a given period of time. Several factors affect this work rate. One factor is the ability of demolition equipment to shear and transport scrap metal material which may vary in size, thickness and weight. Generally, it is most advantageous to use the largest shearing tool or pulverizer head possible to provide the greatest amount of cutting force and lifting capability. Typically, however, such larger shearing tools or pulverizer heads are provided only on larger tracked vehicles.

Another factor is access and mobility within a demolition site that is typically a complex landscape of constantly changing and disorganized piles of material. It is most beneficial to be able to create and negotiate paths through the material. This requires demolition equipment to be as mobile as possible to be able to navigate the downed building material, and to be able to move and remove waste from the demolition site.

Larger demolition equipment, while providing greater capacity to hold larger shearing tools or pulverizer heads, have the disadvantage of being unable to move effectively and efficiently within the demolition site landscape. Smaller demolition equipment, while more nimble and mobile, lack the larger cutting force tools or pulverizer heads to be able to shear or demolish and move the largest and heaviest pieces of concrete or demolition scrap metal.

Accordingly, there remains a need for demolition equipment and methods able to address the concomitant problems of the need for high performance cutting and pulverizing tools within a complex and variable demolition site landscape, to be able to increase demolition site clean-up in terms of the amount of scrap material that can be processed and removed from a demolition site per unit time, as well as to provide lower operational costs.

SUMMARY OF THE INVENTION

The embodiments of the invention described herein addresses the shortcomings of the prior art.

In general terms, the invention may be described as a shear tool or concrete pulverizer retrofit method, a hybrid shear tool or concrete pulverizer demolition machine, such as one resulting from such a method, and a demolition method that may be carried out using such a demolition machine.

Shear Retrofit Method

The shear retrofit method includes a method of retrofitting a shearing demolition machine, the method comprising retrofitting a relatively lighter shearing demolition machine having a weight less than or equal to about 65,000 pounds with a shearing head that is capable of being attached to a relatively heavier shearing demolition machine having a weight greater than 65,000 pounds. It may more specifically include a method comprising retrofitting a relatively lighter shearing demolition machine having a weight less than or equal to about 65,000 pounds and having a shearing head weighing less than about 3,000 pounds, with a shearing head weighing more than about 3,000 pounds.

In a more preferred embodiment, the method may include: (a) obtaining (1) a relatively heavier shearing demolition machine having a relatively heavier machine boom, a relatively heavier machine arm, and a relatively larger shearing head and (2) a relatively lighter shearing demolition machine having a relatively lighter machine boom and relatively lighter machine arm, and a relatively smaller shearing head; and, without respect to order, (b) removing the relatively heavier machine arm, and relatively larger shearing head from the relatively heavier shearing demolition machine; followed by (c) reconfiguring the relatively heavier machine arm and relatively larger shearing head and attaching the relatively heavier machine arm and relatively larger shearing head to the relatively lighter machine boom of the relatively smaller shearing demolition machine, so as to make operative the relatively heavier machine arm and relatively larger shearing head on the relatively lighter shearing demolition machine carrier.

It is preferred that the relatively heavier shearing demolition machine is at least 85,000 pounds, and that the relatively lighter shearing demolition machine is less than 85,000 pounds.

This method of retrofitting a shearing demolition machine may also be carried out through the following steps: (a) obtaining a relatively larger shearing head adapted to be placed on a relatively heavier shearing demolition machine; (b) obtaining a relatively lighter shearing demolition machine having a relatively lighter machine boom; and (c) reconfiguring the relatively larger shearing head and the relatively lighter machine boom, and attaching the relatively larger shearing head to the relatively lighter machine boom of the relatively smaller shearing demolition machine, so as to make operative the relatively larger shearing head on the relatively lighter shearing demolition machine carrier.

The present invention also includes a shear demolition machine made by a retrofit method of the present invention.

Method of Heavy Demolition using Retrofit Shearing Machine

The present invention also includes a demolition method using a hybrid shearing demolition machine of the present invention. This method includes bringing onto a demolition site a retrofitted shearing demolition machine, the retrofitted shearing demolition machine being a relatively lighter shearing demolition machine having a weight less than 50,000 pounds retrofitted with a shearing head that is adapted to be attached to a relatively heavier shearing demolition machine having a weight greater than 80,000 pounds; and operating the retrofitted shearing demolition machine at the demolition site so as to cut and remove scrap therefrom.

Concrete Pulverizer Retrofit Method

The concrete pulverizer retrofit method includes a retrofitting a relatively lighter pulverizing demolition machine having a weight less than or equal to 65,000 pounds with a pulverizing head that is adapted to be attached to a relatively heavier pulverizing demolition machine having a weight greater than 65,000 pounds. It is preferred that the relatively lighter shearing demolition machine have a weight less than or equal to about 65,000 pounds and a pulverizing head weighing less than or equal to about 3,000 pounds, and that the retrofitted pulverizing head weigh more than about 4,000 pounds.

In a more preferred embodiment, the method may include: (a) obtaining (1) a relatively heavier pulverizing demolition machine having a relatively heavier machine boom, a relatively heavier machine arm, and a relatively larger pulverizing head and (2) a relatively lighter pulverizing demolition machine having a relatively lighter machine boom and relatively lighter machine arm, and a relatively smaller pulverizing head; and, without respect to order, (b) removing the relatively heavier machine arm, and relatively larger pulverizing head from the relatively heavier pulverizing demolition machine; followed by (c) reconfiguring the relatively heavier machine arm and relatively larger pulverizing head and attaching the relatively heavier machine arm and relatively larger pulverizing head to the relatively lighter machine boom of the relatively smaller pulverizing demolition machine, so as to make operative the relatively heavier machine arm and relatively larger pulverizing head on the relatively lighter pulverizing demolition machine.

It is preferred that the relatively heavier pulverizing demolition machine is at least 85,000 pounds, and that the relatively lighter pulverizing demolition machine is less than 85,000 pounds.

This method of retrofitting a pulverizing demolition machine may be carried out through the following steps: (a) obtaining a relatively larger pulverizing head adapted to be placed on a relatively heavier pulverizing demolition machine; (b) obtaining a relatively lighter pulverizing demolition machine having a relatively lighter machine boom; and (c) reconfiguring the relatively larger pulverizing head and the relatively lighter machine boom, and attaching the relatively larger pulverizing head to the relatively lighter machine boom of the relatively smaller pulverizing demolition machine, so as to make operative the relatively larger pulverizing head on the relatively lighter pulverizing demolition machine.

The present invention also includes a pulverizing demolition machine made by a retrofit method of the present invention.

Method of Heavy Demolition using Retrofit Concrete Pulverizer

The present invention also includes a demolition method using a hybrid pulverizing demolition machine of the present invention. The present invention also includes a demolition method comprising bringing onto a demolition site a retrofitted pulverizing demolition machine, the retrofitted pulverizing demolition machine being a relatively lighter pulverizing demolition machine having a weight less than 50,000 pounds retrofitted with a pulverizing head that is adapted to be attached to a relatively heavier pulverizing demolition machine having a weight greater than 80,000 pounds; and operating the retrofitted pulverizing demolition machine at the demolition site so as to pulverize and remove concrete waste therefrom.

BRIEF DESCRIPTION OF THE DRAWINGS

FIG. 1 is a side elevation view of a reconfigured and retrofitted demolition machine that may be adapted as a demolition shear or concrete pulverizer machine apparatus in accordance with one embodiment of the present invention.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will now be described in detail with regard for the best mode and preferred embodiment.

FIG. 1 is a side elevation view of a reconfigured and retrofitted demolition machine that may be adapted as a demolition shear or concrete pulverizer machine apparatus in accordance with one embodiment of the present invention.

FIG. 1 shows smaller machine tractor vehicle 1 bearing smaller machine boom 2 bearing the reconfigured machine arm 3 that may be the shear arm or concrete pulverizing arm adapted for a larger tractor vehicle as described herein.

For instance, shearing tool heads commercially available from the Stanley/LaBounty Company of Two Harbors, Minn., and may be used in the hybrid and retrofit machine applications of the present invention. For instance, for bucket linkage shears, the tractor vehicle ("excavator") weight and corresponding attachment weight are normally as follows:

| | (1) EXCAVATOR WEIGHT APPROXIMATE 3rd Member | | (2) ATTACHMENT WEIGHT APPROXIMATE | | (3) JAW OPENING | | JAW DEPTH | |
|---|---|---|---|---|---|---|---|---|
| MODEL | (lbs) | (m tons) | (lbs) | (kg) | (in) | (mm) | (in) | (mm) |
| BLS 40 | 40,000-65,000 | 18-30 | 2,900 | 1,315 | 15-18 | 381-457 | 18 | 457 |
| BLS 80 | 70,000-100,000 | 32-45 | 3,500 | 1,588 | 17-20 | 432-508 | 19.5 | 495 |

By providing a relatively lighter shearing demolition machine having a weight less than or equal to about 65,000 pounds with a shearing head that is capable of being attached to a relatively heavier shearing demolition machine having a weight greater than 65,000 pounds (i.e., replacing a shearing head weighing less than about 3,000 pounds with a reconfigured shearing head weighing more than about 3,000 pounds), a demolition machine better suited for more efficient demolition clean-up operations may be achieved with no diminishment in shearing performance. The relatively larger shearing head is reconfigured so as to be able to be borne by and be operative upon the relatively smaller machine boom, as shown in FIG. 1. This may be done by connecting the relatively larger shearing head with due regard to the balance and articulation required of the relatively smaller machine tractor vehicle 1 and relatively smaller machine boom 2 in combination to be able to accommodate the movement of the reconfigured relatively larger machine arm 3, as well as with due regard to the placement and geometrical arrangement of the associated hydraulic actuators.

As to concrete pulverizers, these tool heads may be obtained commercially available from the Stanley/LaBounty Company of Two Harbors, Minn., and may be used in the hybrid and retrofit machine applications of the present invention. For concrete pulverizers, the tractor vehicle ("excavator") weight and corresponding attachment weight are normally as follows:

| MODEL | # OF TEETH UPPER/ LOWER | (1) EXCAVATOR WEIGHT (APPROX.) (lbs.) | (M Tons) | (2) ATTACHMENT WEIGHT (APPROX.) (lbs.) | (Kg) | (3) JAW OPENING (TIP TO TIP) (APPROX.) (in) | (mm) | (4) STANDARD BACK JAW WIDTH (in) | (mm) | STANDARD JAW DEPTH (TIP TO THROAT) (in) | (mm) |
|---|---|---|---|---|---|---|---|---|---|---|---|
| CP 40 | 3/4 | 36-46,000 | 16-21 | 2,875 | 1,304 | 30 | 762 | 26 | 660 | 25 | 635 |
| CP 60 | 3/4 | 46-65,000 | 21-29 | 3,000 | 1,361 | 36 | 914 | 29 | 737 | 27 | 686 |
| CP 80 | 3/4 | 65-88,000 | 29-40 | 4,475 | 2,030 | 42 | 1,067 | 32.5 | 826 | 29 | 736 |
| CP 100 | 3/4 | 88-111.000 | 40-50 | 6,150 | 2,790 | 48 | 1,219 | 33 | 838 | 35 | 889 |
| CP 120 | 4/5 | 111-160,000 | 50-73 | 9,900 | 4,491 | 54 | 1,372 | 43.5 | 1,105 | 40 | 1,016 |

The preferred embodiment includes retrofitting a relatively lighter pulverizing demolition machine having a weight less than or equal to 65,000 pounds with a pulverizing head that is adapted to be attached to a relatively heavier pulverizing demolition machine having a weight greater than 65,000 pounds (preferably by replacing a pulverizing head weighing less than or equal to about 3,000 pounds with a pulverizing head weigh more than about 4,000 pounds (as may be selected from the above table).

In operation, the demolition machines of the present invention may be used in the conventional manner, but have been found to offer the ideal combination of cutting force and nimble navigation within the demolition site environment, to best navigate through paths of rubble and with increased visibility toward demolished material scrap and workers on site. The combination of the invention also allows scrap material to be efficiently moved off the demolition site for transport and recycling.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A demolition method comprising bringing onto a demolition site a retrofitted shearing demolition machine, said retrofitted shearing demolition machine being a relatively lighter shearing demolition machine having a weight less than 50,000 pounds retrofitted with a shearing head that is adapted to be attached to a relatively heavier shearing demolition machine having a weight greater than 80,000 pounds; and operating said retrofitted shearing demolition machine at said demolition site so as to cut and remove scrap therefrom.

2. The demolition method according to claim 1, wherein said shearing head weighs less than about 3,000 pounds and is replaced with a shearing head weighing more than about 3,000 pounds.

3. The demolition method according to claim 1, further comprising a. obtaining (1) a relatively heavier shearing demolition machine having a relatively heavier machine boom, a relatively heavier machine arm, and a relatively larger shearing head and (2) a relatively lighter shearing demolition machine having a relatively lighter machine boom and relatively lighter machine arm, and a relatively smaller shearing head; and, without respect to order, b. removing said relatively heavier machine arm, and relatively larger shearing head from said relatively heavier shearing demolition machine; followed by c. reconfiguring said relatively heavier machine arm and relatively larger shearing head and attaching said relatively heavier machine arm and relatively larger shearing head to said relatively lighter machine boom of said relatively smaller shearing demolition machine, so as to make operative said relatively heavier machine arm and relatively larger shearing head on said relatively lighter shearing demolition machine.

4. The demolition method according to claim 1, wherein said relatively heavier shearing demolition machine is at least 85,000 pounds.

* * * * *